United States Patent [19]

Graf

[11] Patent Number: 4,552,185

[45] Date of Patent: Nov. 12, 1985

[54] HEALD FRAME

[75] Inventor: Martin Graf, Horgenberg, Switzerland

[73] Assignee: Grob & Co. Aktiengesellschaft, Horgen, Switzerland

[21] Appl. No.: 585,443

[22] Filed: Mar. 2, 1984

[30] Foreign Application Priority Data

Mar. 9, 1983 [DE] Fed. Rep. of Germany ..... 3308371

[51] Int. Cl.[4] ..... D03C 9/06

[52] U.S. Cl. ..... 139/91; 139/92

[58] Field of Search ..... 139/91, 92

[56] References Cited

U.S. PATENT DOCUMENTS 4,015,638 4/1977 Graf ..... 139/91

4,349,052 9/1982 Yaji et al. ..... 139/92

*Primary Examiner*—Henry S. Jaudon

*Assistant Examiner*—Steven Shongut

*Attorney, Agent, or Firm*—Watson, Cole, Grindle & Watson

[57] ABSTRACT

A heald frame comprises two lateral supports which each have a projecting portion (2) which is received in a recess (3) at the end of a frame stave (4). A wedge (9) is mounted in the frame stave (4) within the recess (3) so that it is closer to the heald-carrying rod. A surface (11) of the wedge (9) is inclined towards the end of the frame stave (4) and cooperates with a correspondingly inclined surface (6) at the lower side of the projecting portion (2). The surfaces are pressed together by means of a clamping screw (8) which presses on the opposite surface of the projecting portion (2). The lateral support (1) is pulled against the frame stave (4) as a result of the engagement of the inclined surfaces of the wedge and projecting portion.

2 Claims, 3 Drawing Figures

HEALD FRAME

The present invention relates to a heald frame of the type in which the lateral supports are detachably connected to a profiled hollow frame stave having recessed end sections each adapted to receive a respective projecting portion of one lateral support which is clamped therein by means of a screw.

U.S. Pat. No. 4,015,638 shows a heald frame wherein a clamping screw near to the end of a frame stave is disposed in the plane of the heald frame, but is inclined to the axis of the lateral support and the axis of the frame stave while being inserted from outside the frame stave. The screw is perpendicular to an inclined surface on a projecting portion of the lateral support disposed within a recess of the stave so that the lateral support is pulled against the frame stave by a component of force which acts perpendicularly to the axis of the lateral support. The disadvantage of this arrangement is that the lateral support cannot be longer than the outside distance between the frame staves. Otherwise, the inclined screw inserted close to the edge of the frame stave becomes inaccessible, when the lateral support extends directly beside the screw at the outer edge of the frame stave. Furthermore, because of the requirement for an inclined screw and the provision of an inclined surface on the projecting portion of the lateral support, this arrangement requires an expensive manufacturing process compared to other proposed arrangements of detachably connected lateral supports. The described prior art arrangement cannot be used in any case where the lateral support extends beyond the outer edge of the frame stave by even a few centimeters.

The present invention provides a heald frame comprising lateral supports, a profiled hollow frame stave having recessed end sections each adapted to receive a respective projecting portion of one lateral support which is clamped therein by means of a screw, and a respective wedge disposed in each recess at the side of the frame stave closer to a heald-carrying rod of the frame stave, an upper surface of each wedge being inclined upwardly towards the end of said frame stave and facing towards a cooperating surface of the projecting portion of the lateral support, which cooperating surface has the same inclination as the upper wedge surface, the clamping screw extending through the frame stave parallel to the lateral support to press against said projecting portion so that the cooperating surfaces of the wedge and projecting portion are pressed against each other to produce a force component which pulls the lateral support against the frame stave.

An embodiment of the invention will now be described, by way of example only, with reference to the accompanying diagrammatic drawings, in which.

Figure 1:
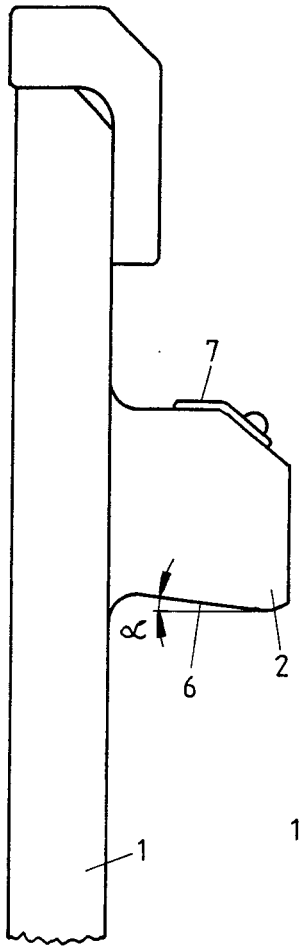
FIG. 1 is a front view of a lateral support with a projecting portion.
Figure 3:
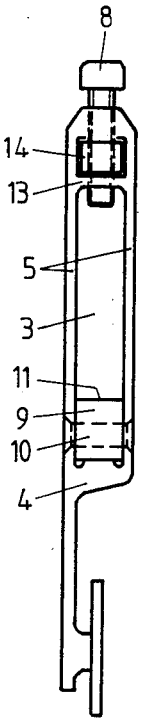
FIG. 3 is a side view of the joined frame stave of FIG. 2 without the lateral support.

FIG. 1 illustrates one end of a lateral support for a heald frame 1 which support has a projecting portion 2 extending from one side. The portion 2 fits into a recess 3 as shown in FIG. 3, which recess is formed in a frame stave 4 between side walls 5 of the frame stave 4 which is shaped as a hollow profile.

At its lower edge, the projecting portion 2 has an inclined surface 6 which extends at an angle $\alpha$ of 5° to 10° relative to the longitudinal axis of the frame stave 4.

Figure 2:
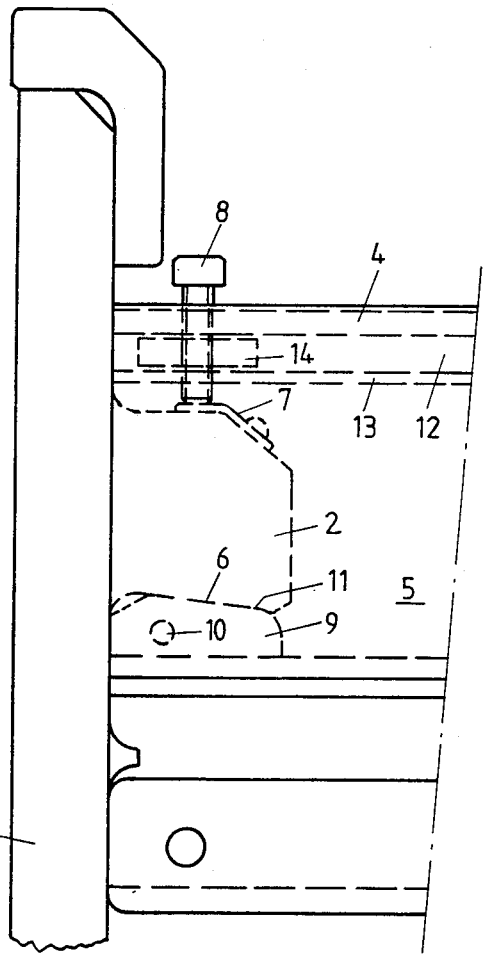
FIG. 2 is a front view of the lateral support detachably connected to a frame stave.

On an opposite horizontally arranged surface of the projecting portion 2, a small plate 7 is fixed in order to protect the surface of the projecting portion against the pressure of a clamping screw 8 when the projecting portion 2 is inserted in the recess 3 of the frame stave 4 as illustrated in FIG. 2.

A wedge 9 is disposed in the recess 3 at the end of the frame stave 4 and closer to the edge defining a heald-carrying rod. The wedge 9 is fixed by means of a rivet 10. An upper surface 11 of the wedge 9 is inclined upwardly towards the end of the frame stave 4 at the same angle $\alpha$ of 5° to 10° to the longitudinal axis of the frame stave as the inclined surface 6 at the lower side of the projecting portion 2. When the projecting portion 2 of the lateral support is inserted into the recess 3 of the frame stave 4, it is placed on top of the wedge 9. As the screw is tightened both inclined surfaces 6 and 11 come into contact with each other.

The frame stave 4 which is extruded as a hollow profile with its recess 3 has another channel-shaped recess 12 which is separated from the main recess 3 by a separation wall 13 through which the clamping screw 8 extends. A key 14 is inserted in the channel-shaped recess 12. The key 14 is provided with a thread matching that of the clamping screw 8.

While tightening the clamping screw 8 which extends parallel to the lateral support 1, a pressure acting in the same direction as the axis of the screw causes a perpendicular component force to press the projecting portion 2 onto the wedge 9, and due to the arrangement of the inclined surfaces 6 and 11 a further component force results which pulls the lateral support against the frame stave.

It will be appreciated that by aligning the screw 8 parallel to the frame stave it remains accessible even if the lateral support extends beyond the edge of the frame stave as shown. Further the manufacture of the described arrangement can be carried out economically.

I claim:

1. A heald frame comprising at least one frame stave having a recess in at least one end thereof, at least one lateral support having a projection protruding from one side thereof adjacent one end of the lateral support and adapted to be inserted in said recess so that said stave and said support are disposed at right angles to each other, said projection having a lower bearing surface, and connecting means for detachably securing said projection within said recess, said connecting means comprising screw means supported by said stave and extending into operative engagement with said projection in said recess to detachably secure said projection therein, a rigid wedge disposed in said recess and affixed to said stave at a side thereof closer to a heald-carrying rods of said stave, an upper surface of said wedge being inclined upwardly toward said one end of said stave and facing toward said bearing surface of said projection, said bearing surface having the same inclination as said upper surface of said wedge, said screw means being disposed in the plane of said frame, lying parallel to said lateral support, and bearing against said projection so that said surfaces of said wedge and said projection are pressed against one another to produce a component of force exerted in said projection parallel to said stave to draw said lateral support against said end of said stave and a component of force exerted on said projection parallel to said support to clamp said projection in said recess of said stave.

2. A heald frame as claimed in claim 1, wherein the upper surface of said wedge is inclined by between 5° and 10° to the longitudinal axis of the frame stave.

* * * * *